US005743813A

United States Patent [19]

Chen et al.

[11] Patent Number: 5,743,813

[45] Date of Patent: Apr. 28, 1998

[54] GOLF CLUB HEAD

[75] Inventors: Kuang-Wei Chen, Kaohsiung Hsien; Yung-Hao Cheng, Kaohsiung, both of Taiwan

[73] Assignee: Chien Ting Precision Casting Co., Ltd., Ping Tung, Taiwan

[21] Appl. No.: 802,853

[22] Filed: Feb. 19, 1997

[51] Int. Cl.[6] ..... A63B 53/04

[52] U.S. Cl. ..... 473/329; 473/342; 473/345

[58] Field of Search ..... 473/324, 329, 473/332, 345, 346, 347, 348, 349, 350, 342

[56] References Cited

U.S. PATENT DOCUMENTS

| | | | |
|---|---|---|---|
| 2,034,936 | 3/1936 | Barnhart | 473/329 |
| 4,027,885 | 6/1977 | Rogers | 473/342 |
| 4,252,262 | 2/1981 | Igarashi | 473/342 |
| 4,398,965 | 8/1983 | Campau | 473/329 |
| 5,398,929 | 3/1995 | Kitaichi | 473/342 |
| 5,403,007 | 4/1995 | Chen | 473/342 |
| 5,431,396 | 7/1995 | Shieh | 473/342 |
| 5,467,983 | 11/1995 | Chen | 473/342 |
| 5,588,922 | 12/1996 | Schmidt et al. | 473/32 |

*Primary Examiner*—Sebastiano Passaniti

*Attorney, Agent, or Firm*—Morton J. Rosenberg; David I. Klein; Jun Y. Lee

[57] ABSTRACT

A golf club head has a hollow body, and a face consisting of three layers, a first (outer) layer made of stainless steel, a second (intermediate) layer made of non-metal elastic and shock-absorbing material and a third (inner) layer made of stainless steel so as to furnish the head with stability and shock-absorbing function.

1 Claim, 3 Drawing Sheets

GOLF CLUB HEAD

BACKGROUND OF THE INVENTION

This invention relates to a golf club head, particularly to that having a face consisting of three layers, two—an outer and an inner—steel layers and an intermediate elastic shock-absorbing layer.

Persons who delight in playing golf pay attention to golf clubs whether they are comfortable for gripping and stable in hitting a ball or not.

Nowadays, known common conventional golf club heads shown in FIG. 4 has a hollow head body 10 made of stainless steel, a hole 20 formed in a bottom and closed up with a cap welded therein, and a face 30 made of carbon fiber or special titanium alloy for hitting a ball. Then, when the face 30 hits a ball, it can stabilize the head and control the ball with its elasticity absorbing shock of hitting a ball.

However, the face 30 made of carbon fiber or titanium alloy may offset the force of hitting by its shock-absorbing function.

SUMMARY OF THE INVENTION

The purpose of the invention is to offer a golf club head having a face consisting of an outer hard layer made of stainless steel, an elastic intermediate layer and an inner hard layer made of stainless steel.

The characteristics of the invention is the outer hard layer of the face possible to hit a ball with the hitting force not directly absorbed, and the intermediate elastic layer of the face possible to absorb shock produced after hitting so as to obtain stability of the head and control of the ball.

BRIEF DESCRIPTION OF DRAWINGS

This invention will be better understood by referring to the accompanying drawings, wherein.

DESCRIPTION OF THE PREFERRED EMBODIMENT

Figure 1:
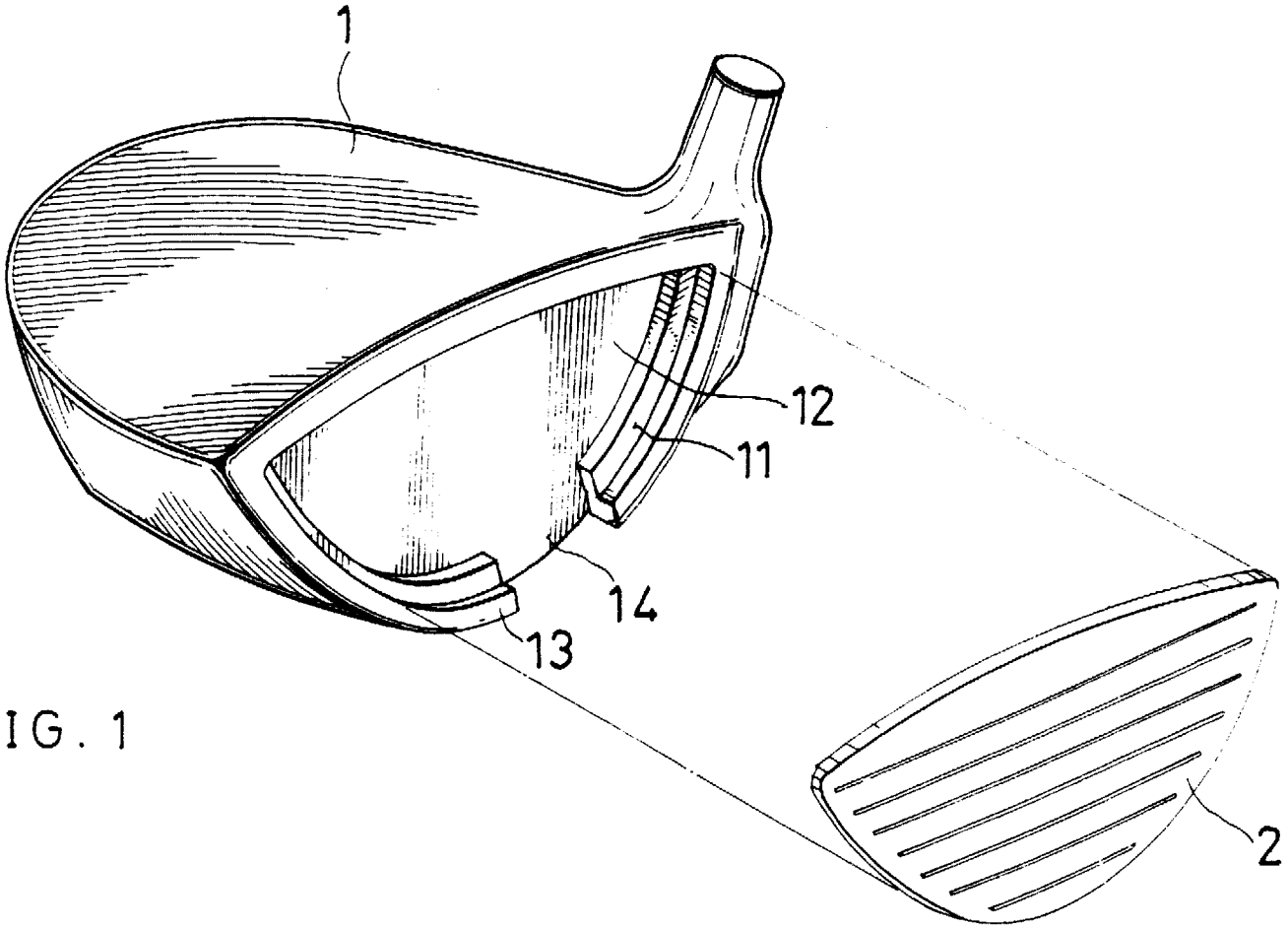
FIG. 1 is an exploded perspective view of a golf club head in the present invention.
Figure 3:
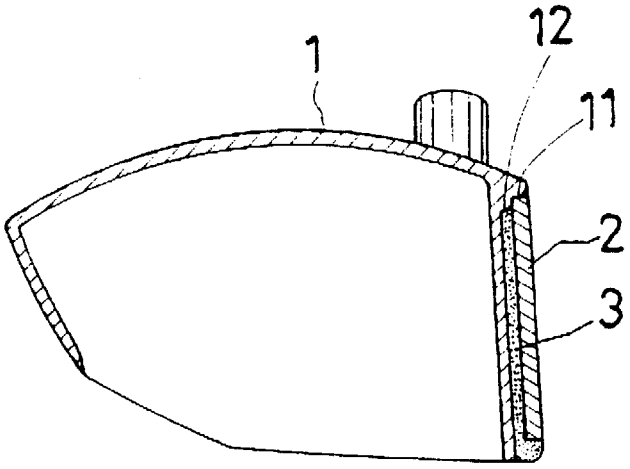
FIG. 3 is a cross-sectional view of the golf club head with an intermediate layer of non-metal material fixed behind an outer hard layer of the face in the present invention; and, FIG. 4 is a perspective view of a known conventional golf club head.
Figure 2:
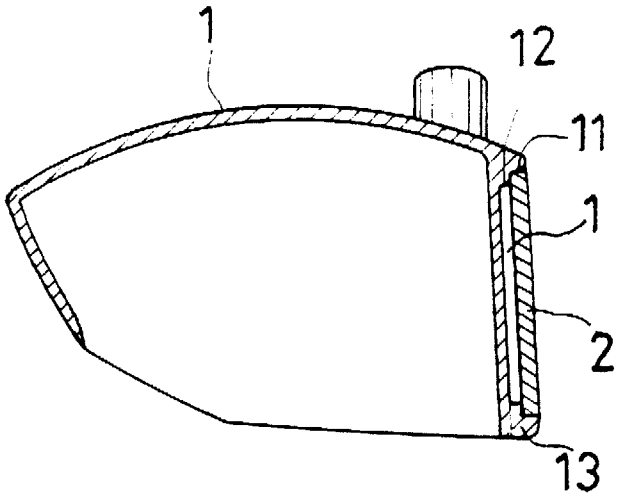
FIG. 2 is a cross-sectional view of the golf club head in the present invention.
Figure 4:
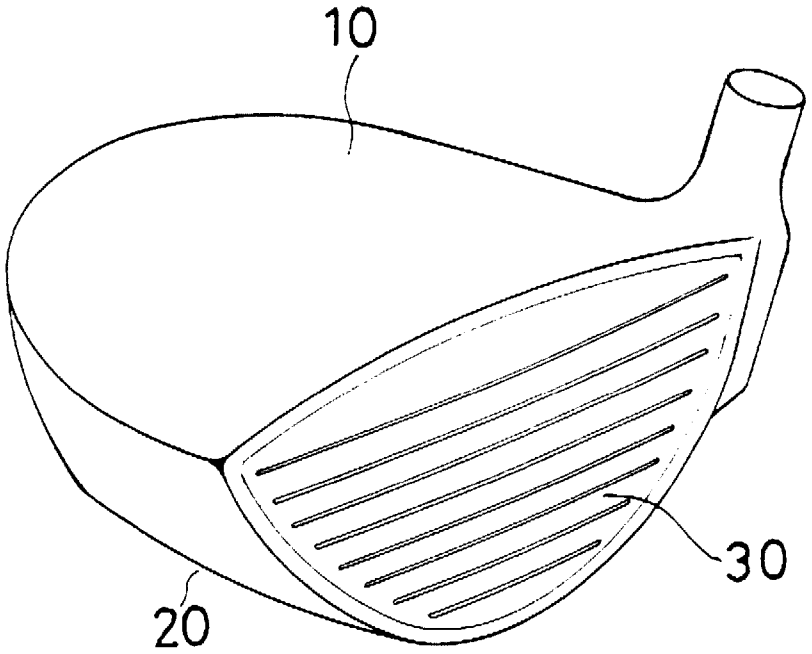
FIG. 4 (PRIOR ART)

A preferred embodiment of a golf club head in the present invention, as shown in FIG. 1, includes a hollow body 1, a first layer of opening 11 and a second layer of opening 12 communicating with the first layer of opening 11 formed in a front side of the hollow body 1, a projecting out annular peripheral edge 13 defining the first layer of opening 11 and the second layer of opening, and an aperture 14 formed in the projecting out annular peripheral edge 13. Then an outer stainless steel layer of the face 2 is fitted in the first opening 11 and then welded with the annular peripheral edge 13, as shown in FIG. 2. A non-metal material 2 is filled in the second layer of opening 12 between the outer stainless steel layer of the face 2 and a rear stainless steel layer of the face 2, as shown in FIG. 3. The non-metal material 3 is considerably elastic and shock-absorbing so that the face has three layers, with the first and the third layer being stainless steel, and with the second layer being elastic and shock-absorbing. Then this golf club head may have stability and shock-absorbing absorbing function in hitting a ball.

While the preferred embodiment of the invention has been described above, it will be recognized and understood that various modifications may be made therein and the appended claims are intended to cover all such modifications which may fall within the spirit and scope of the invention.

What is claimed is:

1. A golf club head comprising:

a hollow head body having a stainless steel face with a recess formed therein, said recess being circumscribed by an annular peripheral edge having an inwardly directed annular ledge raised above a bottom surface of said recess, said annular peripheral edge having an opening formed therethrough in open communication with said recess;

a stainless steel face plate secured to said hollow head body and having a peripheral edge portion of a lower surface thereof disposed in contiguous relationship with said annular ledge, said face plate forming a closure for a cavity defined in said recess between said lower surface of said face plate and said bottom surface of said recess; and, an elastic material substantially filling said cavity for forming a shock absorber to absorb shocks generated by said face plate striking a ball.

* * * * *